United States Patent [19]

Bon

[11] Patent Number: 4,606,805

[45] Date of Patent: Aug. 19, 1986

[54] ELECTROLYTE PERMEABLE DIAPHRAGM AND METHOD OF MAKING SAME

[75] Inventor: Charles K. Bon, Concord, Calif.

[73] Assignee: The Dow Chemical Company, Midland, Mich.

[21] Appl. No.: 564,991

[22] Filed: Dec. 23, 1983

Related U.S. Application Data

[63] Continuation of Ser. No. 414,709, Sep. 3, 1982, abandoned.

[51] Int. Cl.[4] ..... C25B 13/00; B28B 1/26

[52] U.S. Cl. ..... 204/296; 264/60; 264/86; 264/87; 162/103; 162/115; 162/145; 162/157.5

[58] Field of Search ..... 204/296, 295, 98, 252, 204/283, 128; 264/60, 86, 87; 162/103, 115, 145, 157.5

[56] References Cited

U.S. PATENT DOCUMENTS

| | | | |
|---|---|---|---|
| 4,070,257 | 1/1978 | Motani | 204/98 |
| 4,126,536 | 11/1978 | Balko et al. | 204/296 |
| 4,153,661 | 5/1979 | Ree et al. | 264/120 |
| 4,210,515 | 7/1980 | Patil et al. | 204/266 |
| 4,289,601 | 9/1981 | Kadija | 204/296 |
| 4,311,566 | 1/1982 | McCann | 204/98 |

OTHER PUBLICATIONS

Derwent Abstract DAIK 23.03.76 of Japan patent application No. J5 2115-445.

*Primary Examiner*—John F. Niebling
*Attorney, Agent, or Firm*—Merton B. Lilly

[57] ABSTRACT

A method for making an electrolyte permeable diaphragm, and the diaphragm thus produced, wherein an aqueous slurry, containing as its principal particulate ingredient a water-wettable, insert, micron-size, inorganic material, along with both polyfluoroethylene fibers and polyfluoroethylene dispersion, is drawn through a foraminous structure to form a diaphragm thereon.

41 Claims, No Drawings

ELECTROLYTE PERMEABLE DIAPHRAGM AND METHOD OF MAKING SAME

CROSS-REFERENCE TO RELATED APPLICATION

This is a continuation of application Ser. No. 414,709, filed Sept. 3, 1982, now abandoned.

BACKGROUND OF THE INVENTION

Diaphragm electrolytic cells are well known and widely employed in the production of chlorine and caustic. Customarily, the diaphragm is formed from asbestos fibers which are deposited on a foraminous structure, such as a cathode, by drawing the diaphragm from a slurry onto the surface of the cathode member. The life of a diaphragm has heretofore presented no particular problem because the graphite anodes which were widely used needed to be replaced before the diaphragms. When the electrolytic cells were down for replacement of the anodes the diaphragms were also replaced. The new metal anodes now being used commercially, however, have a life substantially longer than the graphite anodes, thus making longer lasting diaphragms desirable. Furthermore, the small clearances between the metal-type anodes which are interdigited with the finger-type cathodes make the use of asbestos diaphragms difficult due to the bridging of the narrow gap between the electrodes by asbestos fibers. An additional reason for considering asbestos-free diaphragms is the environmental concern about the use of asbestos.

One solution to this particular problem is the use of preformed diaphragms made of various plastic materials. These diaphragms are normally manufactured in sheet form and must be fitted about one electrode, either the anode or the cathode, in order to separate the catholyte and anolyte compartments. Patents disclosing such preformed diaphragms made of various types of plastics and containing various fillers, pore-formers, etc., include U.S. Pat. Nos. 3,930,979; 4,020,235; 4,036,729; 4,089,758; 4,098,672; 4,126,536; 4,170,540; and 4,184,939.

U.S. Pat. No. 4,210,515 describes, as one alternative form of the invention claimed, a diaphragm which is vacuum deposited from a slurry composed of discrete fibers of a self-bonding thermoplastic material and a surfactant. One modification suggests that talc and other inorganic wetting aids may be incorporated into the plastic material.

U.S. Pat. No. 4,311,566 describes a method for making a diaphragm for electrolytic cells wherein a slurry is made of non-asbestos, fibrous material, a binder and a pore-forming material. The slurry is drawn through a foraminous electrode to produce the diaphragm. The pore-forming material is removed, either by destruction through heating or through solution.

SUMMARY OF THE INVENTION

An improved method is provided for making an electrolyte permeable diaphragm, as well as the improved diaphragm thus produced, wherein said diaphragm is formed on a foraminous structure for use in an electrolytic cell, which comprises producing an aqueous slurry containing as particulate materials (1) a major portion of a water-wettable, inert, inorganic, micron-size material, (2) polyfluoroethylene fibers, and (3) polyfluoroethylene dispersion, drawing said slurry through the foraminous structure to deposit the particulate materials thereon in the form of a diaphragm, drying the diaphragm and heating the diaphragm to sinter the polyfluoroethylene dispersion particles in the diaphragm.

DETAILED DESCRIPTION OF THE INVENTION

In practicing the present invention, the general procedures and the equipment currently employed in the production of asbestos-containing diaphragms may be used. Furthermore, the present invention may be employed in connection with the hollow, finger-type, foraminous electrodes currently in wide use in the electrolytic production of chlorine and caustic.

An aqueous slurry is made, containing as one of the particulate materials, at least 50 percent by weight of a water-wettable, inert, inorganic, micron-size material. All of the percentages used in this application refer to percentages by weight unless otherwise stated. The inorganic material should be water-wettable in order to be readily dispersed in the aqueous media. Also, the other particulate materials included in the slurry are hydrophobic in nature so that a hydrophilic or water-wettable material is needed to enable the resulting diaphragm to be wetted by the aqueous electrolyte in the electrolytic cell.

It is essential that the inorganic material be substantially inert in the cell liquors in which the diaphragm is to be used. There are, of course, no known materials that are completely inert in the cell liquors, but only those materials which retain their integrity over a period of twelve months or more have any practical application.

Materials which fill the above requirements are all inorganic and include talc, various metal silicates, the alkali metal (including magnesium) titanates and zirconates, and magnesium aluminates such as spinel.

Micron-size inorganic materials have produced the most satisfactory diaphragms. By "micron-size" is meant those materials whose average diameter may vary from about 0.2 micron up to as much as about 10 microns, with particles of about 1.5 microns being preferred. Particles which are substantially larger than 10 microns in average diameter produce diaphragms having such a rapid flow of electrolyte therethrough that they result in an inefficient electrolytic cell.

The inorganic material should constitute at least about 50 percent of the weight of the particulate materials in the slurry and may range as high as about 95 percent. Preferred diaphragms contain from about 70 to about 90 percent of inorganic materials, with about 81 percent being most satisfactory.

A second particulate material included in the slurry is polyfluoroethylene fiber. The term "polyfluoroethylene", as used herein, is meant to include any polymer of a halogenated ethylene wherein the halogen atoms consist of at least one fluorine atom and the balance, if any, chlorine. The fluorine atoms appear to impart stability to the polymer when used in electrolytic cells. A preferred material for use in the present invention is polytetrafluoroethylene.

The word "fiber" refers herein to a product in elongated form which may or may not be branched or feathered. These fibers may have a diameter of from about 1 to about 10 microns and may vary in length from about 1/32 inch to about ½ inch. There is nothing critical as regards the present invention as to the specific length of these fibers but fibers of about ¼ inch in length are preferred. These fibers make possible the deposition of the particulate materials on the foraminous structure from a slurry and add to the structural integrity of the resulting diaphragm. An example of polyfluoroethylene fibers is material that is sold by E. I. duPont de Nemours and Company under the trade name of Teflon® FLOC. Teflon® is duPont's trade name for a polytetrafluoroethylene. The polymeric fibers employed in the present invention frequently occur commercially in the form of "floc" or bundles of fibers which need to be combed apart or separated for proper dispersion in the aqueous slurry for the most advantageous practice of the present invention.

The amount of polyfluoroethylene fibers employed is held to a minimum because of its expense. Enough of the fibrous material must be used, however, to enable deposition of the particulate materials on the foraminous structure when drawing the diaphragm from the slurry. The amount of polyfluoroethylene fiber needed will vary with the particular inorganic material employed, and may range from about 1 to about 20 percent of the total weight of the particulate materials in the slurry, with about 5 to about 20 percent being preferred, and with about 9 percent being most preferred for inorganic materials such as talc.

The third particulate material included in the slurry of the present invention is a polyfluoroethylene dispersion. This dispersion (sometimes referred to as a latex) comprises very small droplets of polyfluoroethylene dispersed in an aqueous medium, which usually includes various wetting or dispersing agents. Examples of such a dispersion include the polytetrafluoroethylene dispersions sold by E. I. duPont de Nemours and Company under the trade names Teflon® 120 Dispersion and Teflon® 30 Dispersion. The polyfluoroethylene dispersion functions as a binder for the inert, inorganic particles and is used in minor amounts ranging from about 2 percent to about 30 percent, of the weight of particulate materials in the slurry, with about 5 to about 30 percent being preferred, and with amounts approximating 10 percent being most preferred. Again, the amount of polymeric dispersion required will vary with the particular inorganic material used in the slurry.

A slurry is made up by adding the particulate materials above-described to an aqueous medium to obtain a concentration of about 170 to about 200 grams of particulate material per liter of aqueous medium. This addition is accompanied by sufficient stirring to obtain uniform wetting and dispersion of the particulate materials. Cell effluent is the preferred aqueous medium, since it is readily available and also because it produces diaphragms having excellent porosity. Cell effluent from electrolytic cells used in the production of sodium hydroxide and chlorine normally contains from about 50 to about 200 grams per liter of sodium hydroxide and from about 260 to about 160 grams per liter of sodium chloride. As used herein "cell effluent" includes synthetically produced cell effluent, that is, any aqueous media to which caustic or salt may be added in the amounts normally found in the effluent from the chlorine/caustic cells. The aqueous medium for the slurry may be distilled or deionized water or water to which no salt or caustic has been added, or it may be water containing a number of inorganic salts or caustic materials added thereto, with or without various wetting agents. In practicing the process of the invention, a foraminous structure, which is usually a hollow, finger-type electrode, is lowered into the slurry and the particulate materials deposited on the surface of the electrode by drawing the slurry therethrough by means of a vacuum applied to the interior of the electrode. This procedure is similar to that customarily employed in making the standard asbestos-type diaphragms, except that care must be exercised not to draw excessive amounts of the particulate materials through the openings in the foraminous structure or electrode. To avoid this, drawing of the slurry on commercial size cathodes is begun at a very low vacuum as measured in the interior of the foraminous structure (up to about 3 inches of mercury for example) and is gradually increased after the diaphragm begins to form on the foraminous structure, to a full vacuum of about 20 inches of mercury. During the course of the drawing process, the electrode is removed at various stages from the slurry, with the vacuum still being applied to dry the diaphragm and to consolidate the mass and make it sufficiently strong to be handled safely. These steps of dipping the diaphragm and drying it are continued until a diaphragm of the desired thickness and weight has been deposited on the electrode.

After the diaphragm has been deposited on the electrode, the diaphragm coated electrode is dried overnight in an oven at a temperature between about 100° C. and about 120° C. Any suitable means for drying the diaphragm coated electrode may be employed, however, as long as a substantial portion of the water is removed from the diaphragm. The next step comprises heating the diaphragm until the polyfluoroethylene dispersion particles sinter or soften to the point that they adhere to one another and to the inert, inorganic particles and polyfluoroethylene fibers. It is probable that some of the polyfluoroethylene fibers soften to the point that they too adhere to other particulate materials in the diaphragm. This sintering step increases the structural integrity of the diaphragm. To sinter diaphragms made from polytetrafluoroethylene these diaphragms are heated to temperatures approximating 350° C. for about one-half hour to effect this sintering or softening. The temperature will vary, of course, with the melting point of the particular polyfluoroethylene employed. It will be apparent to one skilled in the art that the drying and sintering of the diaphragm may be a continuous procedure, beginning at the lower drying temperatures and then increasing the temperature to effect sintering.

Occasionally after sintering commercial size diaphragms, microcracks will appear in the diaphragm due to the difference in expansion between the metal cathode and the talc diaphragm. When this occurs, the vacuum is applied to the diaphragm which is then dipped into the slurry and immediately removed and dried.

The following examples are set forth by way of illustration and not by way of limitation, it being understood that the present invention is limited only as defined in the claims attached hereto.

EXAMPLES

EXAMPLE 1

A. To one liter of cell effluent (approximately 120 grams per liter of sodium hydroxide and 180 grams per liter of sodium chloride in water) were added 16.2 grams of polytetrafluoroethylene fibers. These fibers were stirred into the cell effluent until thoroughly wetted. Then 145.8 grams of powdered talc were added whose particles have a median average dimension of about 1.5 microns. Again, the talc is rapidly stirred until the cell effluent wets the individual talc particles. A dispersion of polytetrafluoroethylene particles in water (60% polytetrafluoroethylene in a basic water solution containing a wetting agent) is added to the slurry containing the fibers and the talc, in an amount sufficient to provide 18 grams of the finely dispersed polytetrafluoroethylene. The slurry is then mixed until a uniform, thick creamy consistency is obtained. The particulate materials in this slurry comprise 81% talc, 10% polytetrafluoroethylene dispersion and 9% polytetrafluoroethylene fibers.

B. The test cathode comprised a 4 inch square sheet of ⅛ inch thick carbon steel having 3/16 inch perforations on 5/16 inch centers. This cathode was placed in a drawing pan. Means for drawing a vacuum of about 26 to about 28 inches of mercury was attached to the drawing pan and the vacuum was turned on. The cathode in the drawing pan was immersed in the slurry of Part A and the particulates in the slurry drawn to the face of the cathode by the vacuum on the pan to form a diaphragm thereon. After 10 seconds, the cathode-pan assembly was removed from the slurry, the diaphragm surface smoothed with a spatula where needed and vacuum dried for five minutes. This was followed by a second dip of the cathode for 5 seconds in the slurry, removal and smoothing of the diaphragm surface and subsequent vacuum drying for 20 minutes. The diaphragm coated cathode was then removed from the drawing pan and dried overnight (about 16 hours) in an oven at temperatures between 100° C. and 120° C. The diaphragm weight was 25 grams.

The oven was then turned up, about 50° C. at a time in half hour steps until the temperature of 350° C. was reached. After holding the temperature at 350° C. for one-half hour, the diaphragm coated cathode was allowed to cool to room temperature.

C. This heat-treated diaphragm-coated cathode of part B above was assembled in a cell body using a facing gasket, so 12.5 square inches of cathode is exposed. This cathode is positioned opposite a ruthenium-titanium anode. After filling the cell with tap water, the water was allowed to flow through the cell for 24 hours, thus wetting the diaphragm as well as washing most of the sodium hydroxide and sodium chloride from it. Brine (water containing about 300 grams per liter of sodium chloride) was then substituted for the tap water and passed through the cell. An electric current of 6 amps was then applied to the cell and the cell operated for 49 days at about 80° C. The average cell voltage was 2.68 volts and the average sodium hydroxide concentration in the catholyte was 78 grams per liter. As used in this and the following examples the word "average" means the average of all the voltages or concentrations measured during the last 50 days of cell operation, or during the entire period of cell operation if less than 50 days. These "averages" do not include start-up or any other explainable yet extreme data points.

EXAMPLE 2

In order to test the effect of the aqueous medium in which the diaphragm is drawn on the operational characteristics of the resulting diaphragm, the procedures of Example 1 were followed with the exception of the aqueous drawing medium. The following Table 1 records the results.

TABLE 1

| Drawing Medium | Days of Operation | Average Voltage | Average gpl NaOH |
|---|---|---|---|
| Cell effluent | 49 | 2.68 | 78 |
| 120 gpl KOH; 180 gpl NaCl | 49 | 2.66 | 77 |
| Deionized water | 49 | 2.84 | 101 |

EXAMPLE 3

Various fillers were substituted for the talc of Example 1. In each instance, these fillers were finely divided materials having particle sizes averaging between 1 and 10 microns. Again, the procedures of Example 1 were followed with the exception of the cathode design and the particulate materials, which were as indicated in the following Table. In place of the 4 inch square cathode plate of Example 1B, a round cathode composed of the same perforated metal plate was used. After the facing gasket was in place, this round cathode plate had the same 12.5 square inches of facing exposed to the cell liquors.

The polytetrafluoroethylene fiber and dispersion of Example 1 are referred to in Table 2 simply as "fiber" and "dispersion" respectively.

TABLE 2

| Cathode Design | Particulate Materials | Days of Operation | Average Volts | Average gpl NaOH |
|---|---|---|---|---|
| Round | 89.5% Spinel<br>6.5% dispersion<br>4.0% fiber | 92 | 2.86 | 108 |
| Round | 80% $K_2TiO_3$<br>10% dispersion<br>10% fiber | 20 | 3.01 | 94 |
| Square | 93% $MgTiO_3$<br>2% dispersion<br>5% fiber | 40 | 2.74 | 147 |

EXAMPLE 4

In order to evaluate different diaphragm compositions, a series of diaphragms were drawn according to the procedure set forth above in Example 1, parts A, B and C. Again, as in Example 3 above, the polytetrafluoroethylene fibers and dispersions listed in Table 3 below are simply "fiber" and "dispersion".

TABLE 3

| Composition | Days of Operation | Average Volts | Average gpl NaOH |
|---|---|---|---|
| 85% talc<br>5% dispersion<br>10% fiber | 15 | 2.72 | 118 |
| 85% talc<br>2% dispersion<br>13% fiber | 15 | 2.74 | 118 |
| 90% talc<br>5% dispersion<br>5% fiber | 7 | 2.77 | 129 |
| 92% spinel<br>6% dispersion<br>2% fiber | 15 | 2.76 | 173 |

It will become apparent from the above detailed description of the invention, as well as the Examples above set forth, that many variations and modifications may be made in the particular embodiments of the invention set forth herein without departing from the invention.

Other variations and modifications of the present invention will become apparent to those skilled in the art, and the present invention is to be limited only as set forth in the following claims.

What is claimed is:

1. A process for forming an electrolyte permeable diaphragm on a foraminous structure for use in an electrolytic cell, which comprises producing an aqueous slurry containing as particulate materials from about 5 to about 20 percent of polyfluoroethylene fiber, from about 5 to about 30 percent polyfluoroethylene dispersion, and from about 50 to about 95 percent of a water-wettable, inert, inorganic, micron-size material, drawing the slurry through the foraminous structure to deposit the particulate materials thereon in the form of a diaphragm, drying the thus deposited diaphragm, and heating said diaphragm to sinter the polyfluoroethylene dispersion particles.

2. The process of claim 1 wherein the polyfluoroethylene is polytetrafluoroethylene.

3. The process of claim 1 wherein the inorganic material is talc.

4. The process of claim 2 wherein the inorganic material is talc.

5. The process of claim 4 wherein the slurry contains about 9 percent of polytetrafluoroethylene fiber, about 10 percent polytetrafluoroethylene dispersion and about 81 percent of talc.

6. A diaphragm made in accordance with the process of claim 1.

7. A diaphragm made in accordance with the process of claim 4.

8. A process for forming an electrolyte permeable diaphragm on a foraminous structure for use in an electrolytic cell for producing chlorine and caustic, which comprises making a slurry using an aqueous medium and containing as undissolved, particulate materials from about 5 to about 20 percent polyfluoroethylene fiber, from about 5 to about 30 percent polyfluoroethylene dispersion, and from about 50 to about 95 percent of a water-wettable, inert, inorganic, micron-size material, said slurry containing from about 170 to about 200 grams per liter of said undissolved particulate materials, depositing a diaphragm on the foraminous structure by drawing the slurry therethrough using first a very low vacuum which is subsequently increased to a high vacuum, drying the diaphragm, and heating the dried diaphragm to sinter the polyfluoroethylene dispersion to promote the structural integrity of the diaphragm.

9. The process of claim 8 wherein the polyfluoroethylene is polytetrafluoroethylene.

10. The process of claim 9 wherein the inorganic material is talc.

11. The process of claim 8 wherein the inorganic material is talc.

12. The process of claim 8 wherein the aqueous medium is water without salts or caustic added thereto.

13. The process of claim 9 wherein the aqueous medium is effluent from the electrolytic cell in which the diaphragm is to be used.

14. The process of claim 8 wherein the particulate materials in the slurry are present in concentrations of about 170 to about 200 grams per liter of aqueous medium, the polyfluoroethylene is polytetrafluoroethylene and the inorganic material is talc.

15. A process for forming an electrolyte permeable diaphragm on a foraminous structure for use in an electrolytic cell for producing chlorine and caustic which comprises making a slurry using an aqueous medium containing from about 50 to about 200 grams per liter of sodium hydroxide and from about 260 to about 160 grams per liter of sodium chloride dissolved in the water, and containing as undissolved particulate materials from about 5 to about 20 percent polytetrafluoroethylene fiber, from about 5 to about 30 percent polytetrafluoroethylene dispersion, and from about 50 to about 90 percent of talc, said slurry containing from about 170 to about 200 grams per liter of said undissolved particulate materials, depositing a diaphragm on the foraminous structure by drawing the slurry through said structure using first a very low vacuum which is subsequently increased to a high vacuum, drying the diaphragm, and heating the diaphragm to sinter the polytetrafluoroethylene dispersion to promote the structural integrity of the diaphragm.

16. A diaphragm made in accordance with the process of claim 15.

17. The process of claim 2 wherein the inert material is selected from the group consisting of talc, metal silicates, alkali metal titanates, alkali metal zirconates and magnesium aluminates.

18. The process of claim 1 wherein the inert material is selected from the group consisting of talc, metal silicates, alkali metal titanates, alkali metal zirconates, and magnesium aluminates.

19. A diaphragm made in accordance with the process of claim 18.

20. A process for forming an electrolyte permeable diaphragm on a foraminous structure for use in an electrolytic cell, which comprises producing an aqueous slurry containing as particulate material (1) from about 1 to about 20 percent polyfluoroethylene fibers, (2) from about 2 to about 30 percent polyfluoroethylene dispersion, and (3) from about 50 to about 95 percent of a water-wettable, inert inorganic, micron-size material, drawing said slurry through the foraminous structure to deposit the particulate materials thereon in the form of a diaphragm, drying the diaphragm and heating the diaphragm to sinter the polyfluoroethylene dispersion particles in the diaphragm.

21. The process of claim 20 wherein the inorganic material is talc.

22. The process of claim 20 wherein the aqueous slurry preferably contains from about 70 to about 90 percent inorganic material.

23. The process of claim 20 wherein the inorganic material has an average particle diameter from about 0.02 to about 10 microns.

24. The process of claim 20 wherein the polyfluoroethylene fiber has a diameter from about 1 to about 10 microns.

25. The process of claim 24 wherein the polyfluoroethylene fiber has a length from about 1/32 to about ½ inch.

26. The process of claim 20 wherein the polyfluoroethylene is polytetrafluoroethylene.

27. The process of claim 20 wherein the water removal and sintering steps are a continuous procedure.

28. A diaphragm made in accordance with the process of claim 17.

29. The process of claim 20 wherein the aqueous slurry preferably contains from about 70 to about 90 percent inorganic material.

30. The process of claim 20 wherein the inorganic material has an average particle diameter from about 0.02 to about 10 microns.

31. The process of claim 20 wherein the polyfluoroethylene fiber has a diameter from about 1 to about 10 microns.

32. The process of claim 20 wherein the polyfluoroethylene fiber has a length from about 1/32 to about ½ inch.

33. The process of claim 3 wherein the talc has an average particle diameter from about 0.02 to about 10 microns.

34. The process of claim 15 wherein the vacuum pressure applied to the diaphragm is gradually increased from about 3 to about 20 inches mercury.

35. The process of claim 15 wherein the diaphragm is heated to a temperature sufficient to sinter the polyfluoroethylene dispersion.

36. The process of claim 35 wherein the diaphragm is heated to at least a temperature of about 350° C.

37. A process for forming an electrolyte permeable diaphragm on a foraminous structure for use in an electrolytic cell comprising producing an aqueous slurry containing as particulate materials (1) an inorganic, hydrophilic material substantially inert to the electrolyte, (2) polyfluoroethylene fibers, and (3) polyfluoroethylene dispersion; drawing the slurry through the foraminous structure to deposit particulate materials from the slurry onto the foraminous structure in the form of a diaphragm by gradually increasing the vacuum pressure applied to the diaphragm from about 3 to about 20 inches of mercury; removing a substantial portion of the water from the diaphragm; and sintering the polyfluoroethylene dispersion particles in the diaphragm.

38. A process for forming an electrolyte permeable diaphragm on a foraminous structure for use in an electrolytic cell comprising producing an aqueous slurry containing as particulate materials (1) an inorganic, hydrophilic material substantially inert to the electrolyte, (2) polyfluoroethylene fibers, and (3) polyfluoroethylene dispersion; drawing the slurry through the foraminous structure to deposit particulate materials from the slurry onto the foraminous structure in the form of a diaphragm; removing a substantial portion of the water from the diaphragm; by drying the diaphragm at a temperature between about 100° C. and about 120° C.; and sintering the polyfluoroethylene dispersion particles in the diaphragm.

39. A process for forming an electrolyte permeable diaphragm on a formainous structure for use in electrolytic cell comprising producing an aqueous slurry containing as particulate materials (1) an inorganic, hydrophilic material substantially inert to the electrolyte, (2) polyfluoroethylene fibers, and (3) polyfluoroethylene dispersion; drawing the slurry through the foraminous structure to deposit particulate materials from the slurry onto the foraminous structure in the form of a diaphragm; removing a substantial portion of the water from the diaphragm; and heating the diaphragm to a temperature sufficient to sinter the polyfluoroethylene dispersion particles in the diaphragm.

40. The process of claim 39 wherein the diaphragm is heated to a temperature of about 350° C.

41. The process of claim 1 wherein the slurry consists essentially of polyfluoroethylene fiber, polyfluoroethylene dispersion, talc and water.

* * * * *

UNITED STATES PATENT AND TRADEMARK OFFICE

CERTIFICATE OF CORRECTION

PATENT NO. : 4,606,805

DATED : August 19, 1986

INVENTOR(S) : Charles K. Bon

It is certified that error appears in the above-identified patent and that said Letters Patent is hereby corrected as shown below:

Cover page, 4th line of ABSTRACT, "insert" should read -- inert --.

Col. 8, line 33, in Claim 20, "material" should read -- materials --.

Col. 9, line 12, in Claim 34, insert -- of -- between "inches" and "mercury".

Col. 10, line 16, in Claim 39, "formainous" should read -- foraminous --; insert -- an -- between "in" and "electrolytic".

Signed and Sealed this

Twenty-fourth Day of February, 1987

*Attest:*

DONALD J. QUIGG

*Attesting Officer* *Commissioner of Patents and Trademarks*